US010717565B2

(12) United States Patent
Knight

(10) Patent No.: US 10,717,565 B2
(45) Date of Patent: Jul. 21, 2020

(54) DISPENSING CLOSURES AND DISPENSERS

(71) Applicant: RIEKE PACKAGING SYSTEMS LIMITED, Leicester (GB)

(72) Inventor: Simon Christopher Knight, Bridgend (GB)

(73) Assignee: RIEKE PACKAGING SYSTEMS LIMITED, Leicester (GB)

( * ) Notice: Subject to any disclaimer, the term of this patent is extended or adjusted under 35 U.S.C. 154(b) by 0 days.

(21) Appl. No.: 16/072,004

(22) PCT Filed: Jan. 20, 2017

(86) PCT No.: PCT/EP2017/051259
§ 371 (c)(1),
(2) Date: Jul. 23, 2018

(87) PCT Pub. No.: WO2017/125595
PCT Pub. Date: Jul. 27, 2017

(65) Prior Publication Data

US 2019/0023463 A1 Jan. 24, 2019

(30) Foreign Application Priority Data

Jan. 22, 2016 (GB) ..... 1601232.0

(51) Int. Cl.
*B65D 47/08* (2006.01)
*B65D 47/20* (2006.01)

(52) U.S. Cl.
CPC ..... *B65D 47/0838* (2013.01); *B65D 47/2081* (2013.01); *B65D 2205/02* (2013.01)

(58) Field of Classification Search
CPC ..... B65D 47/0838; B65D 47/2081
See application file for complete search history.

(56) References Cited

U.S. PATENT DOCUMENTS 4,506,809 A * 3/1985 Corsette ..... B65D 47/2081 222/213
4,785,978 A * 11/1988 Kano ..... B05B 11/047 215/309

(Continued)

FOREIGN PATENT DOCUMENTS

CN 103373529 10/2013
DE 202004012821 U1 12/2005

OTHER PUBLICATIONS

International Search Report and Written Opinion dated Mar. 8, 2017; International Patent Application No. PCT/EP2017/051259 filed Jan. 20, 2017; ISA/EP.

*Primary Examiner* — Jeremy Carroll
(74) *Attorney, Agent, or Firm* — McDonald Hopkins LLC

(57) ABSTRACT

A dispensing closure for a squeeze bottle comprises an outer element, an intermediate element and an inner element. The outer element (3) comprises an outwardly-deflectable diaphragm (35) surrounding an outlet opening (36). The intermediate element (5) comprises an annular seat (57) underlying the outlet opening (36) of the outer element and support structure (56) for the annular seat, with an inflow opening (552) through the annular seat (57) and an outflow opening (551) through the intermediate element around the annular seat (57). The inner element comprises a blocking portion (48; 148) and support structure (46; 146) mounting the blocking portion in the closure aligned with the annular seat. The diaphragm has an inward closed position in which the annular seat of the intermediate element engages around the outlet opening to block flow, and an outwardly-deflected position in which it allows outflow through the outflow opening and outlet opening. The blocking portion of the inner element has a closed position in which it blocks the inflow opening (552) through the annular seat, and an (Continued)

inwardly-deflected position to allow inflow such as venting or suck-back.

8 Claims, 4 Drawing Sheets

(56) References Cited

U.S. PATENT DOCUMENTS

| | | | | |
|---|---|---|---|---|
| 5,154,325 | A * | 10/1992 | Ryder | B05B 11/047 222/189.06 |
| 5,183,184 | A * | 2/1993 | Ranalletta | B05B 11/007 222/189.09 |
| 9,259,133 | B2 | 2/2016 | Corrandini | |
| 2003/0042274 | A1* | 3/2003 | Johanson | B41J 2/17523 222/387 |
| 2005/0139620 | A1 | 6/2005 | Heukamp et al. | |
| 2006/0037975 | A1 | 2/2006 | Suffa | |
| 2012/0024913 | A1 | 2/2012 | Suffa | |
| 2012/0305566 | A1 | 12/2012 | Kneer | |

* cited by examiner

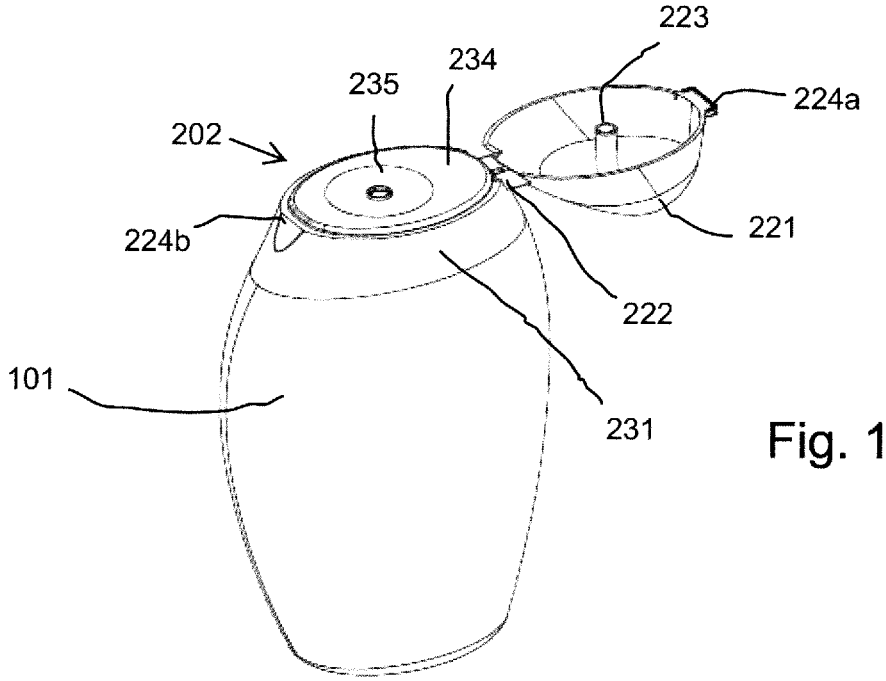
Fig. 11
Fig. 12
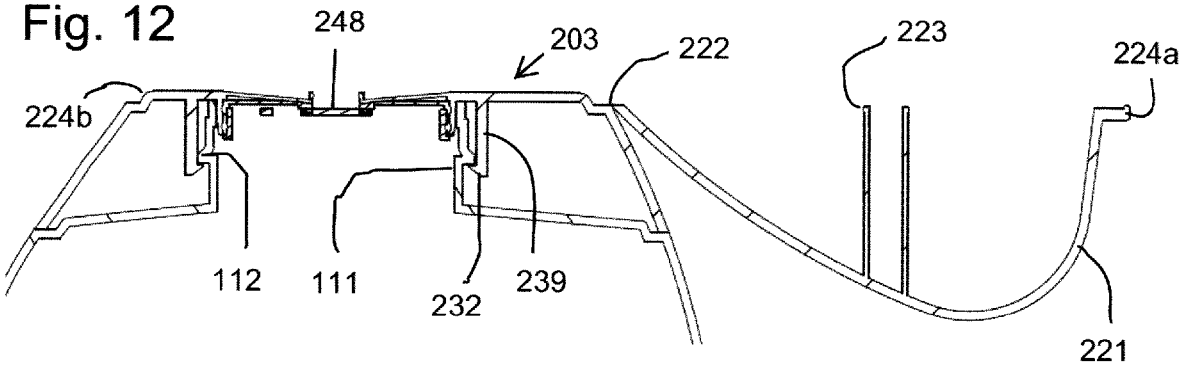
Fig. 13
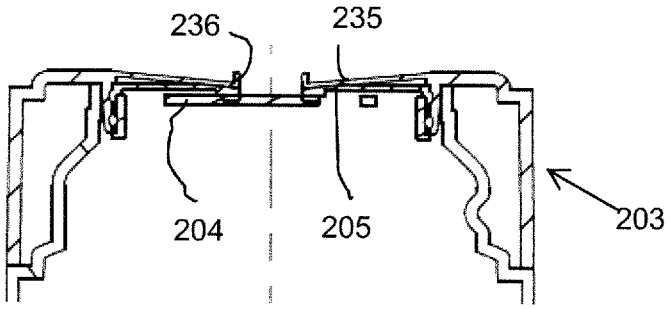

DISPENSING CLOSURES AND DISPENSERS

CROSS-REFERENCE TO RELATED APPLICATION

This application is a 35 U.S.C. 371 national stage filing of PCT Application No. PCT/EP2017/051259 filed on Jan. 20, 2017, entitled "DISPENSING CLOSURES AND DISPENSERS," which claims priority to Great Britain Patent Application No. 1601232.3, filed on Jan. 22, 2016, each of which are incorporated herein in their entirety by reference.

BACKGROUND

This invention relates to dispensing closures for dispensing liquid products from containers, and to dispensers comprising such a closure mounted on or comprised in a product container. The proposals relate particularly but not exclusively to dispensing closures for squeeze dispensers, in which the container is resiliently squeezable to force product out through an outlet path defined through the closure, and subsequently recovers drawing compensation air back into the container. The invention is particularly concerned with valved closures, in which the closure includes a valve device which opens the outflow path for dispensing and closes it when dispensing pressure is relieved. A valve action offers various advantages, such as protecting product in the container against contamination and giving a clean cut-off of dispensed flow when squeezing is relaxed.

Slit silicone valves are widely used for this purpose: an inwardly-convex silicone rubber dome with crossed through-slits is mounted in the outlet opening. Under sufficient dispensing pressure it inverts, i.e. flips to bulge outwardly, and the slits open up for flow. When pressure is relieved the elastomer dome flips rapidly back to its original form, closing the slits. Flow is cut off, and compensation air can enter—perhaps with some suck-back of any residual product on the valve—because much less pressure difference is needed to open the slits enough for reverse air flow. These slit silicone valves work well, but the silicone elastomer is expensive, and neither recyclable nor degradable.

Our aim herein is to provide new and useful types of valved dispensing closure, and corresponding dispensers, especially with a view to providing a mechanism that requires neither special elastomer materials nor auxiliary springs and the like.

THE INVENTION

According to one aspect of our proposals a dispensing closure, through which in use fluid product is dispensed in an outward direction through an outlet path defined through the dispensing closure, includes a valve assembly comprising first and second valve elements and an intermediate element disposed between them.

The intermediate element defines a first flow opening for flow in a first direction (one of inflow and outflow), and a second flow opening for flow in a second, opposite direction (the other of inflow and outflow). The intermediate element provides a first valve seat region bordering the first flow opening and a second valve seat region bordering the second flow opening. The first valve element has a deflectable blocking portion engageable with the first valve seat region in a closed position of the first valve element, and the second valve element has a blocking portion engageable with the second valve seat region of the intermediate element in a closed position thereof. Preferably the intermediate element has first and second oppositely-directed faces, and the first and second blocking elements are deflectable from their closed positions away from the respective faces to open positions in which they are spaced from their respective valve seat regions to allow liquid flow through the respective first or second flow openings.

Typically the mentioned elements are oriented in the closure with the first valve element on the outside (outer valve element) and the second valve element on the inside (inner valve element), the outside typically being the side facing in the direction of dispensing and the inside facing the source of liquid such as a container interior. The closure defines flow clearance past the blocking portions and other structure of the first and second valve elements, so that fluid can flow through the closure when a relevant valve is open.

In a closed position of the valve assembly, typically corresponding to a passive condition without excess pressure from outside or inside, each of the first and second blocking portions engages with its respective valve seat region closing off both the first and second flow openings. Desirably in this closed condition a resilient mounting or nature of one or both of the first and second valve elements, arising preferably from pre-tensioning of the structures thereof (e.g. by moulding them with shapes different from their eventual shapes in the assembly) urges the respective blocking portion against its seal region positively to hold the respective flow opening closed. Thus, the closure can protect an interior region such as container contents from contamination, and prevent inadvertent escape or splashing out of liquid.

Under positive fluid pressure from the second side—when considered as the inner or interior side—such as on squeezing a container containing the product, the valve is operable in an outflow condition in which the excess pressure, acting on the blocking portion of the first valve element via the first flow opening, deflects that blocking portion to the open position, opening up the outlet path. Product then flows out through the mentioned flow clearance via the first flow opening, for dispensing via an eventual outlet opening which may be defined in or by the first valve element, or may be in a separate outlet component.

Finally the valve is operable in a recovery or venting mode in which an excess of pressure exists outside the closure, such when a squeezed resilient container recovers its volume after dispensing and reduces the internal container pressure. Under these conditions the pressure difference acts on the blocking portion of the second valve element, via the second flow opening, deflecting the blocking portion to the open position and away from its valve seat region, for flow in the second direction via the second flow opening. In the typical disposition, this may be a vent flow of compensation air entering the container. If residual liquid product is present at the outer side of the valve assembly, such as at the outlet opening, this product may also be sucked back in through the second flow opening of the closure.

Desirably the closure has a body portion adapted for fixed mounting on or to the container, e.g. onto a container neck, or onto an outlet conduit connected to a container or pump. This body portion is desirably formed integrally, such as being moulded in one piece, with at least one of the mentioned valve elements, preferably the first (outer) valve element. Desirably the intermediate element defining the mentioned flow openings and valve seat regions is substantially fixed in the closure relative to the body thereof, e.g. by virtue of its structure being stiffer than those of the first (outer) and second (inner) valve elements so that in the outflow and venting modes the blocking portions of the valves move while the seating regions hold their position. This feature has the advantage that the characteristics of the first and second valve elements (such as the force needed to open them, the distance of movement and the resulting flow opening sizes) can be varied independently to produce a desired performance. Each valve can operate independently from the other. Preferably the intermediate element is a one-piece entity such as a single moulded part.

Taking the first and second valve elements as being the outer and inner valve elements, we prefer that the outer valve element comprises an outwardly-deflectable diaphragm wall around an outlet opening, preferably the final outlet opening of the closure. There is an annular surround portion around the outlet opening which engages a corresponding annular first (outer) valve seat region on the intermediate element. In the outflow condition the liquid pressure acts on the diaphragm wall to deflect it outwardly, lifting its annular surround portion away from engagement with the first valve seat region so that product can flow out through the outlet opening. The outlet opening is desirably surrounded by the diaphragm wall and preferably centrally positioned in it. For example the outer opening may be axially positioned and axially aligned relative to a container neck in the dispenser. Desirably the diaphragm wall is generally circular. It may be substantially flat in the rest (closed) condition or it may be "dished" inwards or outwards, preferably not more than 20°, or not more than 10°, from its edge to the opening's surround portion. It may have a closed periphery at which it is fixed (non-deflectable) relative to the intermediate element. The most preferable outer valve element comprises a diaphragm wall which is comprised integrally in a cap, especially as part of the top wall of a cap, which is an element of the closure or closure body. The cap may include an outer closure surround with formations for connecting to a container neck, for example it may have a downward skirt with retaining formations, such as thread or snap formations, to engage a container or conduit neck. The diaphragm wall is desirably moulded in one piece with the rest of the cap component and may be a relatively thin portion thereof. This diaphragm wall is preferably the outermost wall of the closure, excepting any removable outer cover, cap or plug which can lift or pivot away for use in dispensing. If such a cover is provided it may have a plug portion that pushes down (inwardly) on the outer element and/or blocks an outlet opening thereof when the outer cover cap or plug is in its closed position. Such an outer cover may be moulded integrally with the outer element, e.g. connected to it by a "live hinge" or it may be a discrete element.

A cap component comprised in or constituted by the outer element may be screwed or snapped onto or into a neck of a container. By means of the present proposals, a valved dispenser pack can be made easily from the container and only three components for the closure, all of which can be fully recyclable if made from suitable material such as polypropylene. Testing has confirmed that bi-directional valve action for dispensing and venting/suck-back is achievable without the need for any elastomer component or separate spring.

Preferably the elements of the valve assembly are centred around an axis extending in the outward direction of the closure. In a preferred arrangement, the second flow opening of the intermediate element (typically for flow in the inflow condition, with the second/inner valve open) is at a central part of the intermediate element, and the first flow opening is at a peripheral region of the intermediate element, e.g. surrounding the second flow opening. For example the second flow opening may be a single central opening encircled by an annular seat surround, and the first flow opening is provided as one or more flow windows surrounding the annular seat surround. The annular seat surround may be connected to a peripheral annular portion, such as a mounting portion, of the intermediate element through a support structure, consisting e.g. of one or more support limbs or spokes. As mentioned it is preferred that this support structure is relatively stiff; for this purpose the one or more support limbs or spokes may be made of thick section, or more preferably with a channel e.g. U-, H- or I-section, to give rigidity. Where the outer valve element has a central flow clearance, such as an outlet opening in a diaphragm wall as mentioned above, the annular surround of this may seal against an outer side of the annular seat surround of the intermediate element, which presents a generally outwardly-directed sealing region. Correspondingly, the blocking portion of the second/inner valve element may then be positioned and shaped to block the central second flow opening of the intermediate element, which may then present a generally inwardly-directed sealing region.

The blocking portion of the second/inner valve element is mounted in alignment with the second flow opening of the intermediate element by support structure comprised in the second valve element, desirably including one or more flexible limbs. Preferably the support structure of the second/inner valve element is mounted to (or in) the outer valve element or the intermediate element, so that the closure is an integrated device. Desirably the inner valve element is a push-fit into or onto the outer valve element and/or into or onto the intermediate element. The inner valve element may have an annular mounting formation, such as an outwardly-directed edge or retaining ring, which may engage in a corresponding inwardly-directed retaining formation of the outer element or intermediate element.

The inner valve element is desirably a generally circular component. Preferably an annular mounting formation of the second/inner element includes an outward flange that extends below an inwardly-directed stiff portion of the outer element, such as a downwardly-facing cap surround portion, so that the flange lies between this and the edge of a container neck in the assembled dispenser. Engaging this flange between the container neck and cap underside can provide a seal, obviating a discrete gasket at this position. It also serves to hold the inner element securely in position, which may then in turn hold the other valve assembly elements securely in position, so that they cannot fall into the container under a heavy impact or push through the outlet opening.

Where the outlet opening is central, the blocking portion of the second/inner valve element is then supported generally centrally in that element, and may be in the form of a disc or plate, or a blocking formation on a disc or plate. Desirably the blocking portion has an outwardly-directed sealing surface, such as an annular surface, shaped and dimensioned to make a seal closing the second flow opening, such as a seal against an annular seat surround portion of the intermediate element defining the second flow opening. The blocking portion may enter or plug into this. Thus, the blocking portion may consist or comprise a circular region, which may be an outward eminence, on a central plate or disc of the inner valve element. This disc or plate may lie in a radial plane of the closure.

The blocking portion of the second/inner valve element is desirably supported relative to an outer fixed part of the support structure via one, two or more flexible limbs so that it is inwardly deflectable as described above to open the second flow opening. The thinner and longer and hence more readily flexible these limbs, the smaller the force required to open the valve for inflow, e.g. for air venting or product suck-back. So, the number and structure of these limbs can be designed to take account of suction forces expected from a product container and the viscosity of the product which may need to be sucked back. One possibility is to support the blocking portion from one (radial) side and not the other, e.g. by a single limb. Deflection of the blocking portion by flexing of this limb is with a tilting action, opening up a relatively large opening on the side opposite the limb e.g. for suck-back of more viscous products. Conversely, supporting the blocking portion from all around, such as by two or more circumferentially-distributed limbs, restricts the maximum dimension of the vent/suck-back opening but improves the quality of the resting seal by inhibiting tilting.

Returning to the intermediate element, a structure with a peripheral first flow opening (especially for outflow) and a central second flow opening (especially for inflow, such as venting/suck-back) is preferred. The first flow opening may be sub-divided by support structures for an annular seat surround of the central flow opening. These support structures may in turn be mounted on a peripheral mounting portion, desirably an annular or part-annular mounting portion, through which the element is connected to the rest of the closure. Desirably this mounting portion fits, e.g. with a snap connection, into or onto the first/outer valve element (or a cap portion with which a valve element may be integral), or with another component of the closure, and/or with the second/inner valve element. Desirably all three of the outer, inner and intermediate elements can click or snap together to form an integrated assembly which can hold itself together even before a container or conduit is connected to the closure. Preferably the intermediate element is generally annular, and generally flat. An outer annulus, which may constitute or incorporate the mentioned mounting formation, can be connected to an inner annular surround as mentioned by one, two, three or more connecting limbs or spokes.

We particularly prefer that the inner element, outer element and preferably also the intermediate element are non-elastomeric. They may be made from thermoplastic materials, such as polypropylene which is both economical and recyclable. They may be three separate parts to be connected together, although options exist for forming them integrally, such as by moulding in an extended position and then folding to oppose them. In a preferred embodiment they are concentric annular components disposed transverse to a central axis which is also the outlet axis and the direction of a container neck or conduit axis.

In another aspect, the present invention provides a dispensing closure comprising an outer element, an intermediate element and an inner element. The outer element comprises an outwardly-deflectable diaphragm surrounding an outlet opening. The intermediate element comprises an annular seat underlying the outlet opening of the outer element and support structure for the annular seat, with an inflow opening through the annular seat and an outflow opening through the intermediate element around the annular seat. The inner element comprises a blocking portion and support structure mounting the blocking portion in the closure aligned with the annular seat. The outer diaphragm wall has an inward closed position in which it engages the annular seat around the outlet opening to block flow, and an outwardly-deflected position in which it allows outflow through the outflow opening and outlet opening. The blocking portion of the inner element has a closed position in which it blocks the flow opening through the annular seat, and an inwardly-deflected position in which it allows inflow through the inflow opening of the annular seat.

A dispenser comprising any closure as disclosed herein connected to a liquid product source or container for liquid, such as a bottle, is another aspect of the invention. As mentioned the closures are well suited for use with resiliently squeezable containers, although in principle they will work in any kind of dispenser which generates forward pressure for dispensing, such as by a pump.

The dispensing closures and dispensers disclosed herein are suitable for use with a wide range of liquid products. Relevant product types include watery liquids, creams and foams, cleaning products such as detergents, food products and food additives such as sauces, condiments, ketchup, mustard and the like, also toiletries and cosmetics.

DESCRIPTION OF THE DRAWINGS

Embodiments of our proposals are now described with reference to the accompanying drawings, in which

FIG. 11 is a perspective view of a dispenser, being a third embodiment of our proposals;

FIG. 12 is a cross-sectional view through the closure of the FIG. 11 dispenser along its long axis, and FIG. 13 is a cross-sectional view through the closure of the FIG. 11 dispenser along its short axis.

DETAILED DESCRIPTION OF EMBODIMENTS

Figure 1:
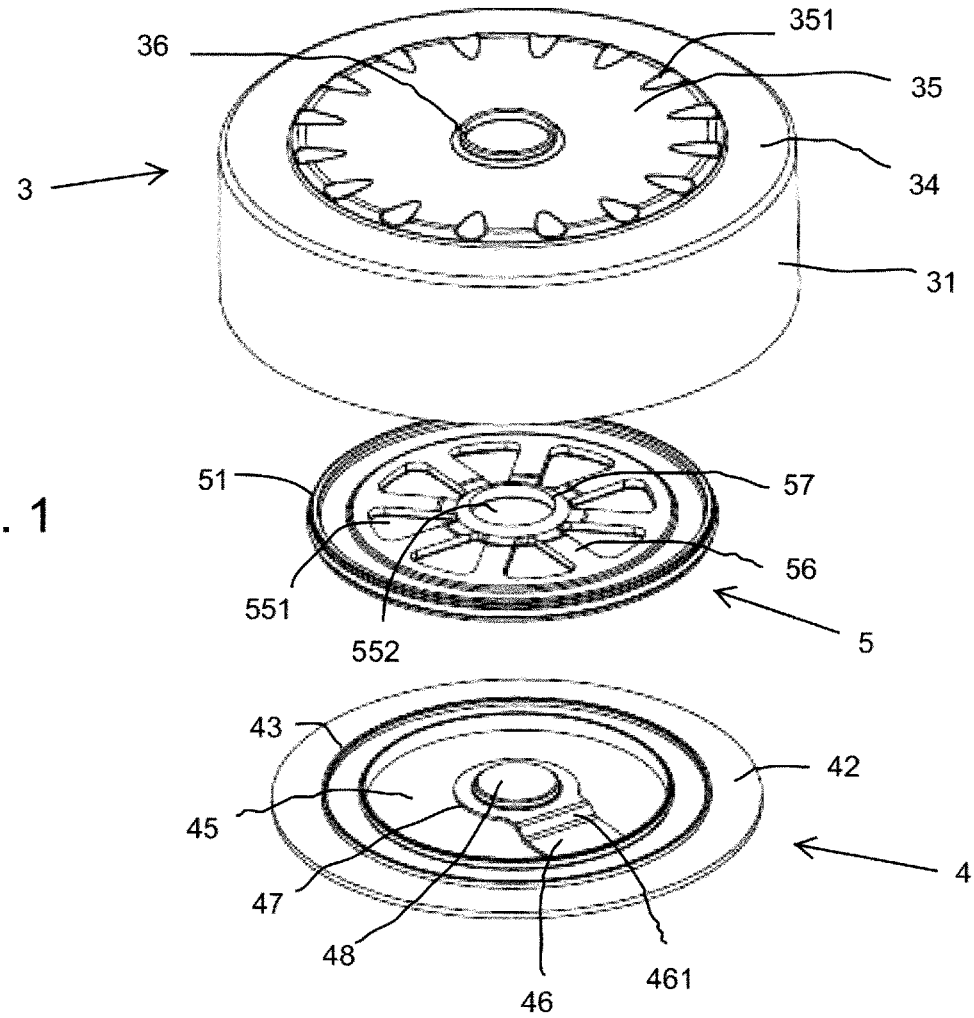
FIG. 1 is an exploded view of a first dispensing closure embodying our proposals.

Referring firstly to FIGS. 1 to 7, a first embodiment of a dispensing closure 2 comprises an outer cap element 3 also constituting an outer valve element, an inner valve element 4 and an intermediate element or valve seat element 5, each moulded in one piece from polypropylene. The outer element 3 includes a securing cap portion with a cylindrical side wall 31 having an inner thread 32 for engaging a container neck (not shown), and a top wall with an outer surround portion 34 of structural thickness, like the side wall 31, and a much thinner diaphragm 35 extending over most of the central region. The diaphragm wall 35 lies very slightly higher than the surround wall 34, defining a step formation on the interior presenting a snap engagement where the intermediate element 5 fixes in: see FIG. 2.

Figure 5:
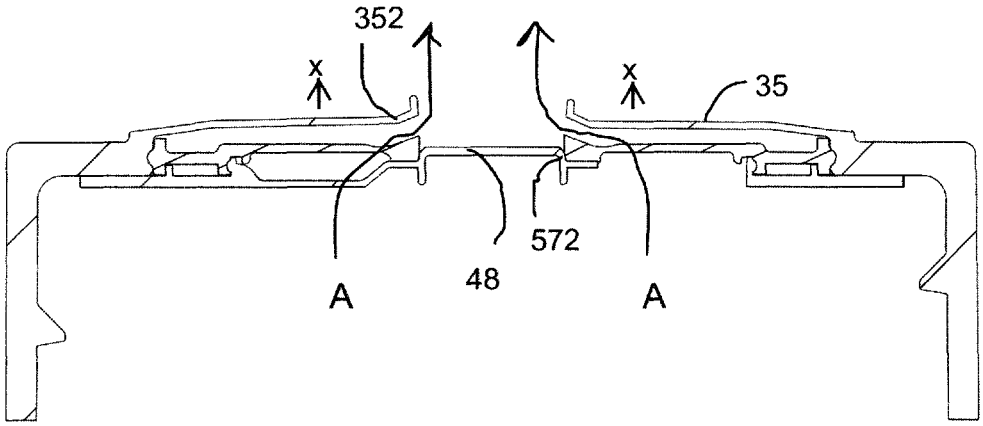
FIGS. 5 and 6 show the positions of the components in the outflow and recovery conditions.
Figure 6:
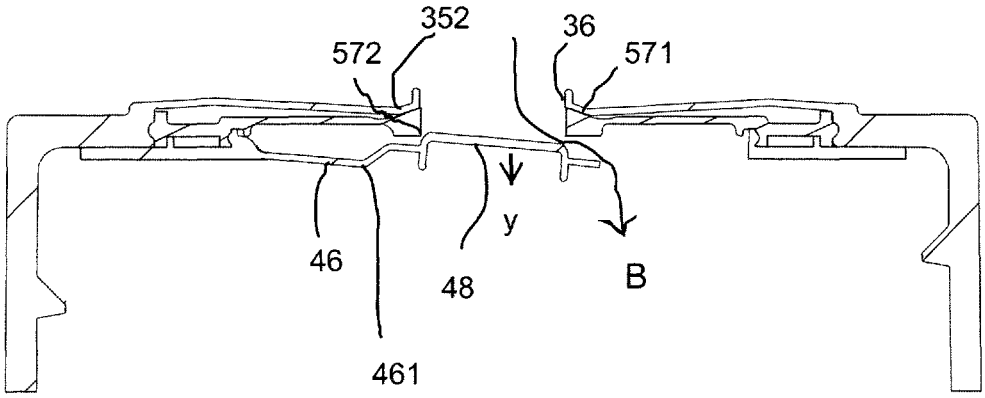

The diaphragm wall 35 is generally planar in the rest condition shown, and has a central outlet opening defined or surrounded in annular surround portion 36 which presents an inwardly-facing annular sealing surface 352 which is conical in form—see FIGS. 5 and 6.

The intermediate element or valve seat element 5 is a generally planar annular component resembling a spoked wheel, having a peripheral mounting ring 51 with a radially-outward snap formation 53 engageable in the corresponding radially-inward snap formation 33 of the outer element, and a set of inwardly (downwardly)-directed annular snap ribs 59 for engaging the inner element 4 described below. A set of eight support limbs 56 in the form of radial spokes supports a central coaxial annular surround or seal seat ring 57 defining a central flow opening (inflow opening) 552. The limbs 56 have a channel form (see FIG. 4) to resist inward and outward bending. The central seal seat ring 57 is essentially fixed in the closure. The upper (outer) side of the ring 57 has a generally conical face 571 complementing the conical seal face 352 of the outer diaphragm wall 35 around the opening 36, forming a valve seat region for the outer diaphragm wall.

The limbs 56 divide the space around the seat ring 57 into eight open segments, each constituting part of an outflow flow opening 551.

Figure 2:
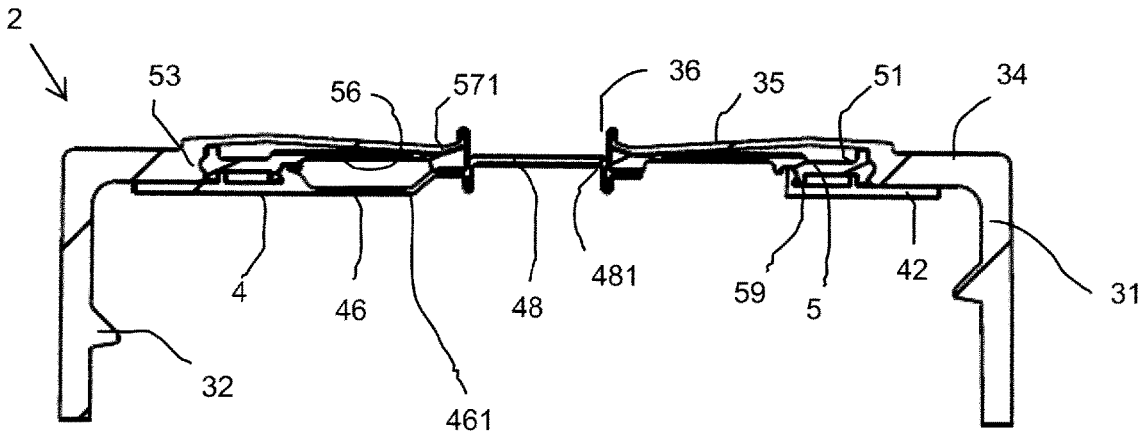
FIG. 2 is an enlarged diametral cross-section through the assembled closure in the closed position.
Figure 3:
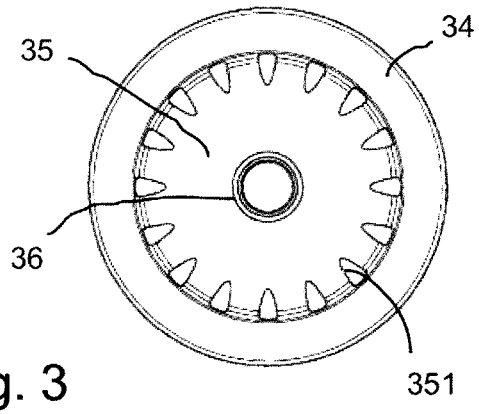
FIGS. 3 and 4 are a top view and bottom view of the assembled closure.
Figure 4:
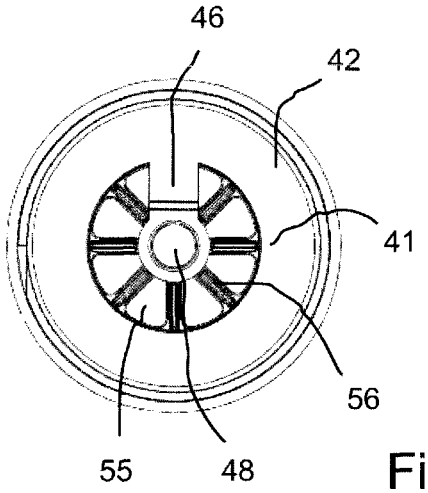

The inner valve element 4 is circular and has a peripheral mounting ring portion 41 having upwardly-directed snap rings 43 which engage with the downwardly-directed snap rings 59 of the intermediate element: see FIGS. 2, 5 and 6.

Around the fixed periphery of the diaphragm 135 a series of indentations 351 is formed. This three-dimensional curving of the thin diaphragm wall increases its stiffness against bending, i.e. improves the restoration force of the valve.

An outer flange 42 projects out radially from around the mounting ring portion 41 and engages the underside of the cap surround 34, improving the seal and location, and being engaged or trapped by the top edge of the container neck (not shown) when this is inserted. The flange 42 constitutes a sealing ring, obviating the separate sealing ring which is commonly used. It also prevents the valve components from falling down out of the cap and into the container.

The inner valve blocking portion is constituted by a coaxial circular boss 48 mounted at one side to the outer ring through a single flexible radial limb 46. A central disc structure 47 underlies the outwardly-projecting boss 48 to improve axial location: as seen in FIGS. 2 and 5 the boss can fit or plug up inside the central opening 552 of the intermediate element seat ring 57 to close it off, with sealing engagement between the periphery of the boss and an annular sealing region 572 to the inside and underside of the seat ring 57. The edge of the disc 47 engages the underside of the ring 57 to hold the boss 48 level. The support limb 46 has an intermediate cranked or corrugated portion 461, with folds running across the limb direction to inhibit twisting.

As mentioned, the intermediate seat disc 5 is generally rigid, while the outer diaphragm 35 and the limb mounting 46 of the inner blocking portion 48 are flexible by virtue of their shape and thin structure. These flexible components have an as-moulded conformation which, relative to what is shown in FIG. 2, is angled towards the intermediate element 5 so that, when assembled as seen in FIG. 2, they have been deformed out against their resilience. This energizes the sealing engagements in the rest position. In the absence of substantial pressure difference across the closure, it remains closed and protects the container contents. Also, it will not drip or splash.

Figure 7:
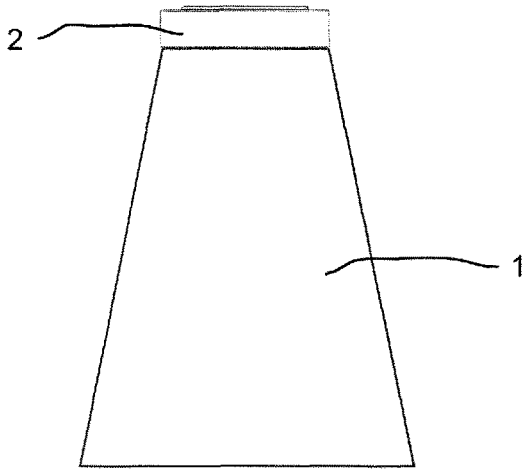
FIG. 7 shows the closure on a squeezable container, to constitute a dispenser.

FIG. 7 shows schematically a dispenser comprising the closure 2 fixed onto a squeezable container 1 by screwing onto a neck of the container.

FIG. 5 shows the outflow (dispensing) condition (in which the container may be tipped or inverted, but not necessarily so). When the container is squeezed, outward liquid pressure acts to bulge the diaphragm wall 35 outwardly as shown in FIG. 5, whereas the rigid seat disc 5 does not bulge. The relative movement disengages the sealing regions 352,571 and opens the outlet 36 for the outflow of product. In FIG. 5 arrows x show the diaphragm movement and A the outflow of product through the outflow openings 551 and outlet opening 36. Under outward pressure the inner valve element 48 continues to block the central opening 552, as in the rest position.

When the dispensing pressure is relieved the squeeze container recovers and a negative pressure difference arises. FIG. 6 shows the situation: the diaphragm wall 35 returns promptly to its flat start condition and seals against the seat ring 57 at 571. Return flow through the outflow openings 551 is therefore shut off.

The negative pressure difference acts also on the central blocking portion 48 of the inner valve element 4, pushing it inwardly out of its sealing seat 571 (arrow y) and deflecting it inwardly by flexion of the support limb 46. The resulting tilting movement of the blocking boss 48 opens up the central inflow opening 552—opening widest at the side opposite the limb 46—for the entry of compensation air shown by arrow B, and any liquid product present at the outlet can also be sucked back into the container. Once the pressures equalize the valve returns to the slightly tensioned closed position of FIG. 2.

Figure 8:
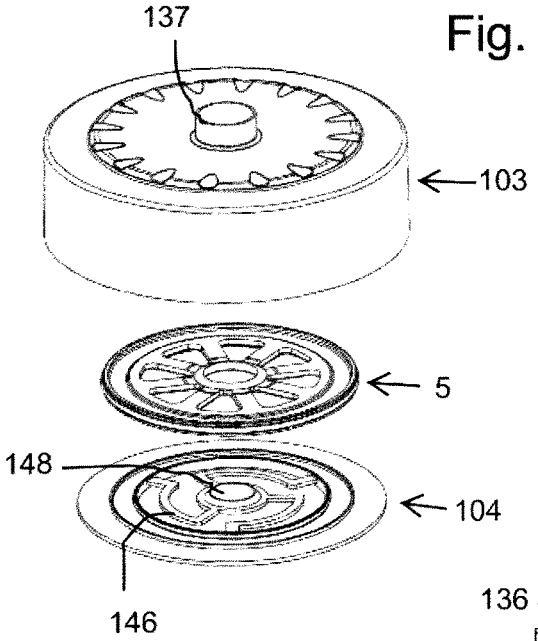
FIG. 8 is an exploded view of a second dispensing closure embodying our proposals.
Figure 9:
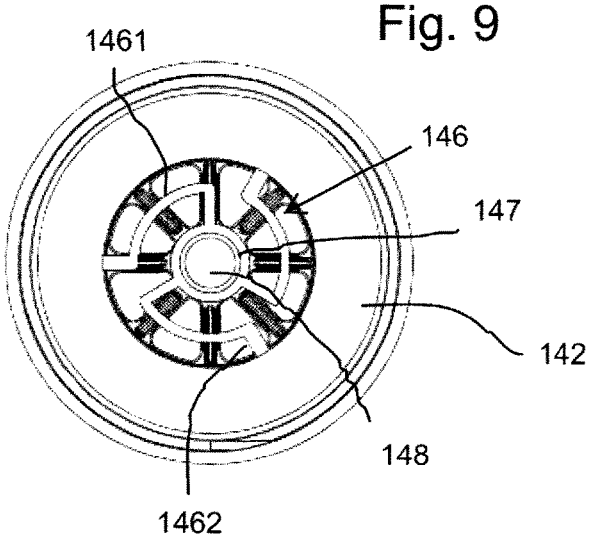
FIG. 9 is a bottom (inside) view of the second closure.
Figure 10:
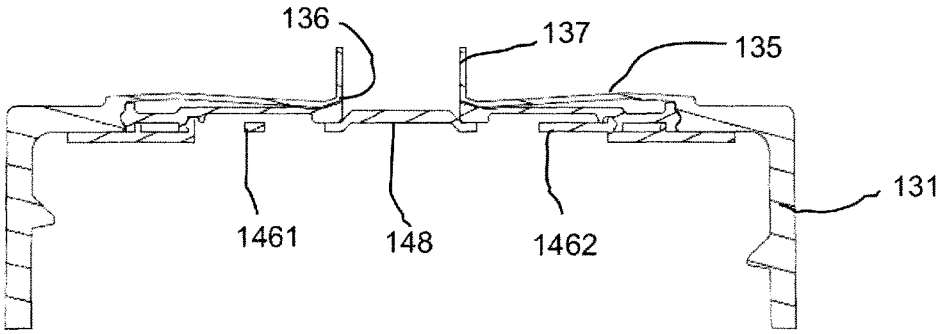
FIG. 10 is an enlarged diametral cross-section through the closure in the closed position.

FIGS. 8 to 10 show a second embodiment of closure which differs from the first embodiment primarily in the nature of the inner valve element 104. A central circular boss 148 is provided as before to constitute the blocking portion, but this is now supported centrosymmetrically by a set of three thin springy limbs 146, each consisting of a combination of radial portions 1462 and circumferential portions 1461 to combine length with thinness giving a very low deflection force. At the same time the symmetrical arrangement of limbs 146 means that the blocking boss 148 moves axially without tilting when it opens, and also is kept perpendicular to the axis in the closed position. This makes a better seal in the closed position, although the dimension of the opening available in the open condition may be slightly less than available in the first embodiment.

Another difference in this embodiment is that the central opening 136 is provided with an outward nozzle formation 137, formed integrally with the diaphragm 135.

In other respects, the operation of the second embodiment is similar to that of the first.

FIG. 11 shows a dispenser with a third embodiment of closure. In this embodiment the squeeze container 101 is oval in horizontal section with a long axis and a short axis, and the closure 202 is similarly oval in form to complement the shape envelope of the container 101. The active components of the closure (outer valve element combined with cap 203, intermediate element 205, inner valve element 204) are generally similar to those of the second embodiment described above, but the outer cap surround 231 is extended to an oval form to blend in with the shape of the container 101. The container in fact has a standard circular (cylindrical) neck 111 with a circular opening, and the cap component has an internal cylindrical skirt 239 which fits around this, having an inward retaining rib 232 engaging an outward rib 112 on the container neck. Accordingly, the top surface of the closure has a larger oval non-deforming surround portion 234, with the circular diaphragm 235 localised in the centre.

A further feature of this embodiment is the provision of a hinged outer cover cap 221, moulded integrally with the cap element and outer valve element and connected via a live hinge 222. The underside of the cap has an axially-projecting closure plug 223 shaped and positioned to push down on the annular surround at the outlet 236 when the cap is closed, holding the outflow passage shut so that liquid cannot leak through the closure and into the cap. To maintain this engagement the cap's outer edge makes a snap engagement 224*a*, 224*b* with the closure surround 231.

The invention claimed is:

1. A dispensing closure comprising an outer element, an intermediate element and an inner element, wherein the outer element comprises an outwardly-deflectable diaphragm surrounding an outlet opening, the intermediate element comprises an annular seat underlying the outlet opening of the outer element and support structure for the annular seat, with a central inflow opening through the annular seat and at least one peripheral outflow opening through the intermediate element around the annular seat, and the inner element comprises a blocking portion consisting of a single, flexible limb connected to a support structure such that the blocking portion seals the central inflow opening;

the diaphragm having an inward, closed position in which the annular seat of the intermediate element engages the outlet opening to block flow, and an outwardly-deflected position away from the closure without further constraint from any portion of the closure for outflow through the outflow opening and outlet opening, and the blocking portion of the inner element having a closed position in which the single, flexible limb it blocks the inflow opening through the annular seat, said single, flexible limb movable to an inwardly-deflected position to open the inflow opening upon exposure to negative pressure.

2. The dispensing closure of claim 1 in which the outer element comprises a cap component to be secured onto or into a neck of a container.

3. The dispensing closure of claim 1 in which the support structure for the annular seat consists of one or more support limbs or spokes.

4. The dispensing closure of claim 3 in which the one or more support limbs or spokes have a channel cross-section for rigidity.

5. The dispensing closure of claim 1 wherein the inner element is a push-fit into or onto the outer element and/or into or onto the intermediate element.

6. The dispensing closure of claim 5 in which the inner element has an annular mounting formation which engages in a corresponding inwardly-directed retaining formation of the outer element or of the intermediate element.

7. The dispensing closure of claim 1 wherein the inner element is a circular component having an annular mounting formation comprising an outward flange that extends below an inwardly-directed portion of the outer element, for said outward flange to lie between said inwardly-directed portion and the edge of a container neck in an assembled dispenser.

8. The dispensing closure of claim 1 wherein the inner element, outer element and intermediate element are made from thermoplastic material.

* * * * *